US010947868B2

(12) United States Patent
Richards et al.

(10) Patent No.: US 10,947,868 B2
(45) Date of Patent: Mar. 16, 2021

(54) BLOCK MOUNTED OVERHEAD CAM SUPPORT SYSTEM FOR INTERNAL COMBUSTION ENGINES

(71) Applicant: Cummins Inc., Columbus, IN (US)

(72) Inventors: Kieran J. Richards, West Haddon (GB); Simon Anthony Burge, Rugby (GB)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/568,815

(22) Filed: Sep. 12, 2019

(65) Prior Publication Data

US 2020/0003084 A1 Jan. 2, 2020

Related U.S. Application Data

(63) Continuation of application No. PCT/US2018/022580, filed on Mar. 15, 2018.

(60) Provisional application No. 62/472,273, filed on Mar. 16, 2017.

(51) Int. Cl.
*F01L 1/053* (2006.01)
*F01L 1/047* (2006.01)

(52) U.S. Cl.
CPC ..... *F01L 1/053* (2013.01); *F01L 2001/054* (2013.01); *F01L 2001/0535* (2013.01); *F01L 2001/0537* (2013.01)

(58) Field of Classification Search
CPC ... F01L 1/053; F01L 1/04; F01L 1/047; F01L 1/185; F01L 2001/0535; F01L 2001/0537; F01L 2001/054; F02B 2275/18; F02B 2275/20; F02F 1/38; F02F 7/00; F02F 7/006; F02F 2007/0063
USPC ..... 123/90.27, 90.34, 193.5, 193.1–193.4; 74/567
See application file for complete search history.

(56) References Cited

U.S. PATENT DOCUMENTS 2,539,387 A * 1/1951 Alden ..... F16B 21/18 301/112
4,333,426 A * 6/1982 Gavasso ..... F01L 1/12 123/90.27
4,449,489 A * 5/1984 Williams ..... F02B 75/042 123/169 PA
5,357,915 A * 10/1994 Yamamoto ..... F01L 1/34403 123/90.16
5,370,090 A * 12/1994 Murata ..... F02F 7/0068 123/90.16
5,564,374 A 10/1996 Hoffman et al.
(Continued)

FOREIGN PATENT DOCUMENTS

CA 1149750 A 7/1983
CH 298627 A 5/1954
(Continued)

OTHER PUBLICATIONS

Searchy Report and Written Opinion, PCT Appln. No. PCT/U18/22580, 10pgs., May 24, 2018.
(Continued)

*Primary Examiner* — Jorge L Leon, Jr.
(74) *Attorney, Agent, or Firm* — Taft Stettinius & Hollister LLP

(57) ABSTRACT

Systems, devices, and methods are disclosed for supporting one or more camshafts by the engine block in overhead arrangement relative to the cylinder heads and valve train.

30 Claims, 7 Drawing Sheets

(56) References Cited

U.S. PATENT DOCUMENTS

| | | | | |
|---|---|---|---|---|
| 5,682,849 | A | 11/1997 | Regueiro | |
| 6,644,256 | B2 * | 11/2003 | Takahara | F01L 13/0036 123/90.16 |
| 6,948,468 | B1 * | 9/2005 | Decuir, Jr. | F01L 1/042 123/90.24 |
| 2003/0010300 | A1 * | 1/2003 | Stretch | F01L 1/267 123/90.15 |
| 2003/0098002 | A1 | 5/2003 | Wenger et al. | |
| 2009/0013958 | A1 | 1/2009 | Kumagai et al. | |
| 2015/0080136 | A1 * | 3/2015 | Kenno | F16D 3/72 464/88 |
| 2016/0108765 | A1 * | 4/2016 | Yoon | F02F 7/006 123/294 |
| 2016/0138438 | A1 | 5/2016 | Genise et al. | |
| 2017/0101902 | A1 * | 4/2017 | Martyn | F01L 1/08 |
| 2019/0032523 | A1 * | 1/2019 | Riley | F01L 1/047 |

FOREIGN PATENT DOCUMENTS

| | | | |
|---|---|---|---|
| GB | 2232212 | | 12/1990 |
| JP | 4333750 | B2 | 9/2009 |
| JP | 2011117423 | A | 6/2011 |

OTHER PUBLICATIONS

European Extended Search Report, Counter EP Appln. Serial No. 18767336.3, 9 pgs, dated Jan. 13, 2021.

* cited by examiner

BLOCK MOUNTED OVERHEAD CAM SUPPORT SYSTEM FOR INTERNAL COMBUSTION ENGINES

CROSS-REFERENCE TO RELATED APPLICATION

The present application is a continuation of PCT Application No. PCT/US18/22580, filed Mar. 15, 2018, which claims the benefit of the filing date of U.S. Provisional Application Ser. No. 62/472,273 filed on Mar. 16, 2017, which is incorporated herein by reference in its entirety.

FIELD OF THE INVENTION

The present invention relates generally to internal combustion engines, and more particularly to systems, devices and methods for a modular overhead cam support system that is mounted to a cylinder block of the internal combustion engine independently of the cylinder head.

BACKGROUND

Large diesel and natural gas engines typically employ cam-in-block arrangements utilizing a push rod driven valve train. Cam-in-block designs can lead to a reduction in strength and stiffness in the cylinder block, additional mass, and service challenges. Cam-in-block designs also incur additional valve train inertia and other losses, and impose limitations on the block and cylinder head design.

By moving the camshaft out of the block and into an overhead position, various different valve train arrangements can be implemented. However, adding the camshaft above the cylinder head has led to restrictions in the serviceability of individual cylinders. Also, long multi-cylinder slab heads are not favorable due to their serviceability and manufacturing complexity. In addition, placing the valve train on top of a slab cylinder head significantly increases the total assembly mass and complexity of the slab head system, negatively impacting the serviceability and repair time for the customer.

As desired cylinder operating pressures increase and more complex valve train arrangements are required for new engine designs, it would be desirable to have flexibility in the engine hardware to be integrated into those designs and be able to share common parts across engine families. Cam phasing, cam timing, cylinder deactivation, cam switching, cam duration, variable valve lift, and cam-less technology will become a significant enabler for engine manufacturers to allow additional optimization and improvement in engine efficiency and emissions reduction. Therefore, further improvements in this technology area are needed to address these issues, among others.

SUMMARY

One embodiment of the present disclosure includes a unique system, method and/or apparatus for a modular overhead cam support system that can be applied to inline and V-type internal combustion engines, where the cam support system is mounted to the engine independently of the cylinder head. The overhead cam support system can be configured for single, twin and other cam or cam-less configurations including cam-in-cam arrangements.

The overhead cam support system in the present disclosure enables the use of a shorter (1, 2, 3 or 4 cylinder) cylinder head while also providing the potential for various overhead valve train and camshaft configurations. The overhead cam support system also enables the use of variable valve actuation (VVA) technology for complex markets including cam phasing of intake and exhaust events as well as variable valve lift and duration. The overhead cam support system can enable the engine architecture to be easily adapted to provide a de-tiered or simple overhead cam arrangement for cost-sensitive less regulated markets.

The overhead cam support system provides modularity and flexibility that enables tailoring of an engine family for different fuel variants while retaining the same base engine architecture and thus reducing the number of new, fuel specific components needed. The overhead cam support system allows for different heads to be interchanged independently of the overhead arrangement, allowing an increase in option flexibility, an increase in part commonality and a reduction in development cost.

The overhead cam support system improves the serviceability of the cylinder head assembly on large, multi-cylinder engines by enabling the use of shorter cylinder heads that span fewer cylinders (1 or 2 or 3 or 4 cylinders at a time). Shorter cylinder heads reduce the mass of the serviceable item and help enable the manual handling of the cylinder heads in the field. This is a significant advantage over longer, heavier slab cylinder heads, such as those used in space constrained environments such as marine, mining and mobile power generation engines due to the limited engine bay space. In addition, repair times are reduced and the modularity provides cost reduction due to the applicability of the overhead cam support system to multiple engine platforms.

The overhead cam support system is also scalable and can enable the use of two cam carrier housings per cylinder bank for dual overhead cam designs. This embodiment can utilize multiple sections of camshaft that are coupled together to span more than one cylinder head assembly. In certain embodiments, two sections of camshaft are used per cylinder bank, but the use of more than two cam sections per cylinder bank is also possible. The coupling between the camshafts can be configured so that one section of the cam carrier housing can be removed without requiring the removal of a neighboring section. The overhead cam support system also includes the option to retain the camshaft assembly and follower assembly to the cam carrier housing when removing for service and assembly. This helps to ensure cam timing and phasing is maintained during routine maintenance and enables the manufacturing facility to sub-assemble the system.

In further embodiments, the overhead cam support system can provide lash adjustment through the use of hydraulic tappets that reduce the need for routine lash maintenance. The overhead cam support system can also provide independent interchangeability of the head assembly to the valve train. Furthermore, the overhead cam support system allows the cylinder head to flex without transferring any loads into the valve train/camshaft assembly, such as may occur in response to intake manifold overpressure (IMOP) events, since the overhead cam support system is mounted to the engine block independently of the cylinder head. The overhead cam support system also provides scalable overhead cam arrangements that work with multiple cylinder head engine arrangements.

This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

BRIEF DESCRIPTION OF THE DRAWINGS

The description herein makes reference to the accompanying drawings wherein like numerals refer to like parts throughout the several views, and wherein.

DESCRIPTION OF THE ILLUSTRATED EMBODIMENTS

Figure 1:
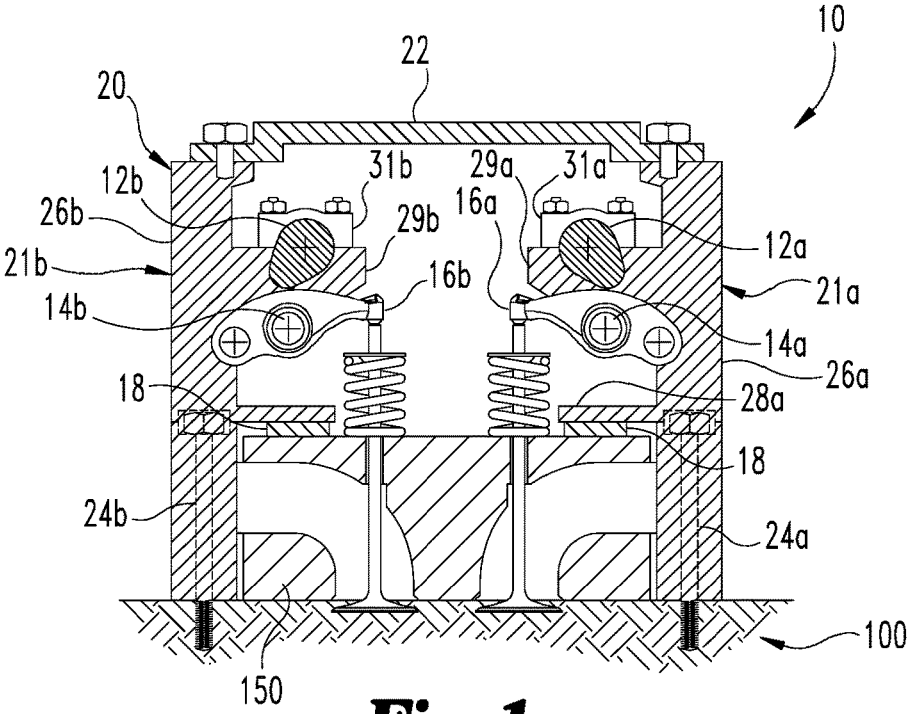
FIG. 1 is a cross-sectional view of a dual overhead cam support system mounted to the engine block.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Figure 2:
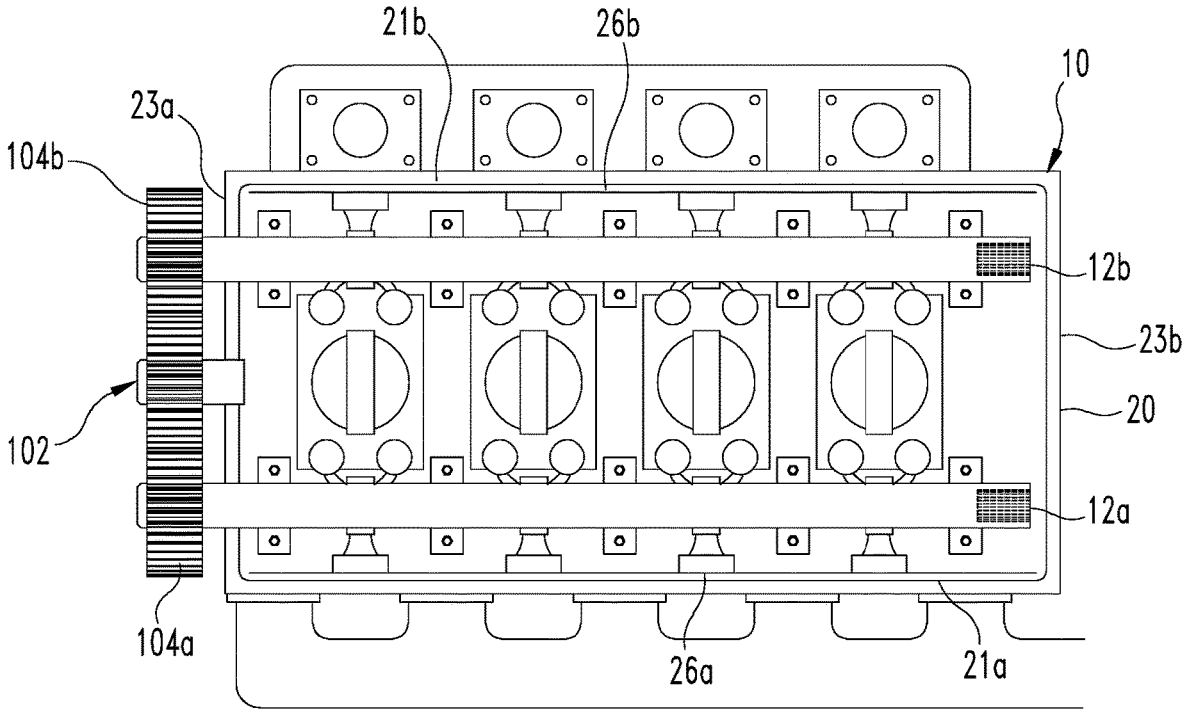
FIG. 2 is a plan view of the dual overhead cam support system of FIG. 1.

FIGS. 1 and 2 show a cross-section view and a plan view, respectively, of a modular dual overhead cam support system according to one embodiment of the present disclosure. It should be understood the cam support system disclosed herein can be employed on other overhead cam arrangements that are not dual overhead camshafts, as discussed above. Cam support system 10 is independently supported on the cylinder block 100 of the engine and not on or by the cylinder head 150. Cam support system 10 allows the cylinder head 150 to flex without transferring any loads into the valve train/camshaft assembly supported by cam support system 10. Cam support system 10 provides scalable overhead cam support arrangements that work with multiple cylinder head types of engines.

FIG. 1 shows two overhead camshafts 12*a*, 12*b* that are each engaged with a respective one of the roller follower valve trains 14*a*, 14*b* with hydraulic lash adjusters 16*a*, 16*b*. Adjusters 16*a*, 16*b* can each include or be connected to an intake valve or an exhaust valve and an associated valve spring. Each intake or exhaust valve is connected to a hydraulic tappet that is connected with a respective roller follower that pivots around a follower pivot. The overhead cam support system 10 is mounted, independently of the cylinder head 150, directly to the engine block 100 and sits above the cylinder head 150. A sealed interface between the head 150 and cam support system 10 is provided by seal 18 (such as an elastomer seal) which keeps oil inside the rocker housing and dirt out.

Cam support system 10 includes a carrier housing 20 to support camshafts 12*a*, 12*b* that in the illustrated embodiment of FIGS. 1-2 is a single or unitary piece. Carrier housing 20 could also be arranged in two pieces to improve assembly and disassembly while in service. Carrier housing 20 includes a first leg 21*a* along one side of cylinder head 150 and a second leg 21*b* along a second, opposite side of cylinder head 150. A valve cover 22 can be engaged to the upper end of the cam carrier 29*a*, 29*b* of carrier housing 20 which is supported on the carrier legs 21*a*, 21*b*. Carrier bolts 24*a*, 24*b* can be provided that extend through bores in carrier housing 20 or alternatively through the carrier legs 21*a*, 21*b* to engage block 100. In the illustrated embodiment, carrier housing 20 includes a vertically extending wall portion 23*a*, 23*b*, 26*a*, 26*b* that includes a lower end sitting on block 100 and an opposite upper end engaged to valve cover 22. Each wall portion 23*a*, 23*b*, 26*a*, 26*b* includes inwardly extending flange 28*a*, 28*b* to provide engagement with seal 18 against head 150. Each wall portion 26 includes a cam support arm 29*a*, 29*b* that supports respectively one of the camshafts 12*a*, 12*b* thereon. A camshaft retaining cap 31*a*, 31*b* can be engaged to respective ones of support arm 29*a*, 29*b* around the correspondingly supported camshaft 12*a*, 12*b*. Carrier housing 20 may also include one or more support structures for rocker pivots, seals for cam-to-cam drive couplings, a cam/rocker cover, and suitable sealing arrangements to prevent the egress of fluids. Carrier housing 20 may also house hydraulic lash adjusters, tappets, and parts of the lubrication circuit for the cam, follower, and hydraulic lash adjusters.

FIG. 2 shows a plan view of the overhead cam support system 10 in a V-8 configuration. Carrier housing 20 includes end walls 23*a*, 23*b* connecting legs 21*a*, 21*b* to provide a rectangular-shaped carrier housing. In another embodiment, the lower portions of the end walls 23*a*, 23*b* can be omitted so legs 21*a*, 21*b* are not directly connected to one another. A common cam drive gear 102 connected to the crank shaft is provided on carrier housing 20 in the center between camshafts 12*a*, 12*b* and two cam gears 104*a*, 104*b*, One drive gear 102 and cam gears 104*a*, 104*b* can be provided for each of the left cylinder bank and the right cylinder bank. For variable valve timing (VVT) or VVA arrangements, the cam gears 104*a*, 104*b* can be interchanged for cam phasers. It is further contemplated that an electric drive, chain, or belt can drive the camshafts 12*a*, 12*b*.

Figure 3A:
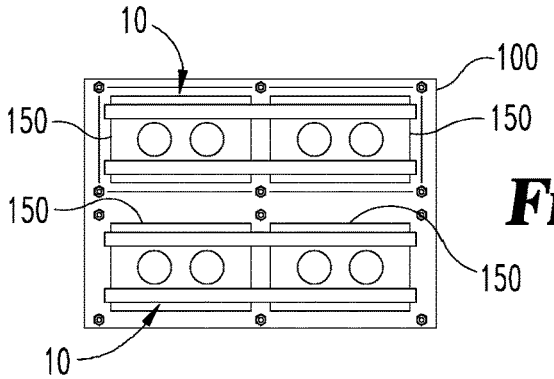
FIG. 3A-3D show various dual overhead cam support system arrangements and engine configurations.
Figure 3B:
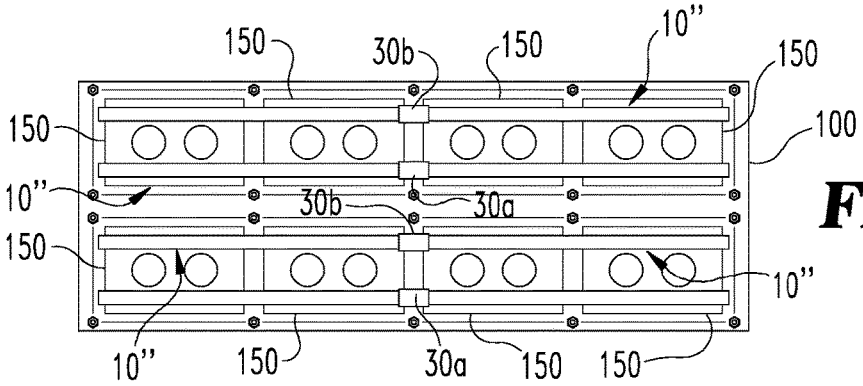
Figure 3C:
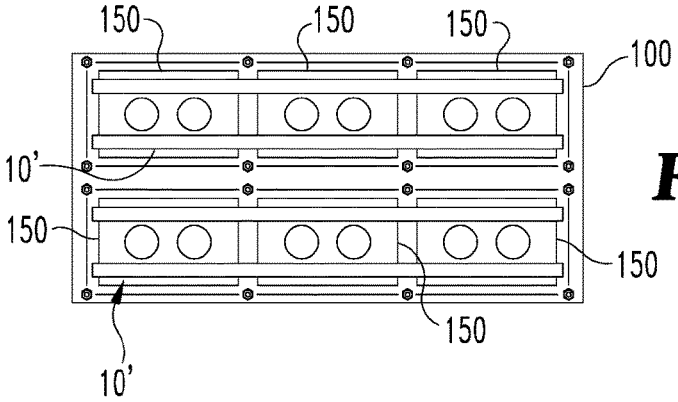
Figure 3D:
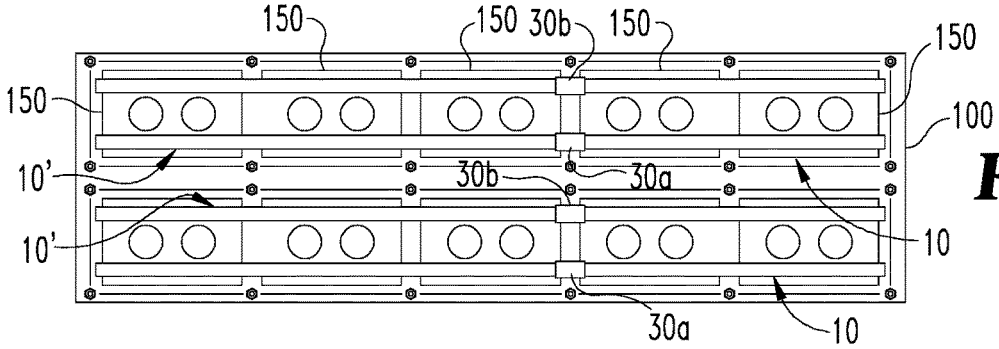

FIGS. 3A-3D show the principle of using multiples of a two cylinder head 150 to cover pairs of engine cylinders including a V-8 in FIG. 3A, a V-16 in FIG. 3B, a V-12 in FIG. 3C, and a V-20 in FIG. 3D. Other engine sizes and cylinder numbers are also contemplated other than those shown. Also shown are cam support systems 10 that span heads that cover two cylinder pairs such as shown in FIG. 3A, and also a cam support system 10' sized to span three cylinder pairs as shown in FIG. 3C, a cam support system 10" sized to extend over four cylinder pairs as shown in FIG. 3B. Combinations of these are also contemplated as shown in FIG. 3D. FIGS. 3B and 3D also show couplings 30*a*, 30*b* (also collectively or individually referred to as coupling 30) to connect two sections of respective ones of the camshafts

12*a*, 12*b* together. In one embodiment of the V-12 engine shown in FIG. 3C, a first camshaft section can be provided that is sized to extend along two cylinder pairs and a second camshaft section is provided to extend along one cylinder pair on each side of the cylinder bank, and the first camshaft section is connected in end-to-end fashion with the second camshaft section. In still another embodiment, a unit head engine is provided with a single head per cylinder. For a V-12 engine, each of the camshaft sections can be connected in end-to-end fashion and are each sized to extend along three cylinders.

Figure 4:
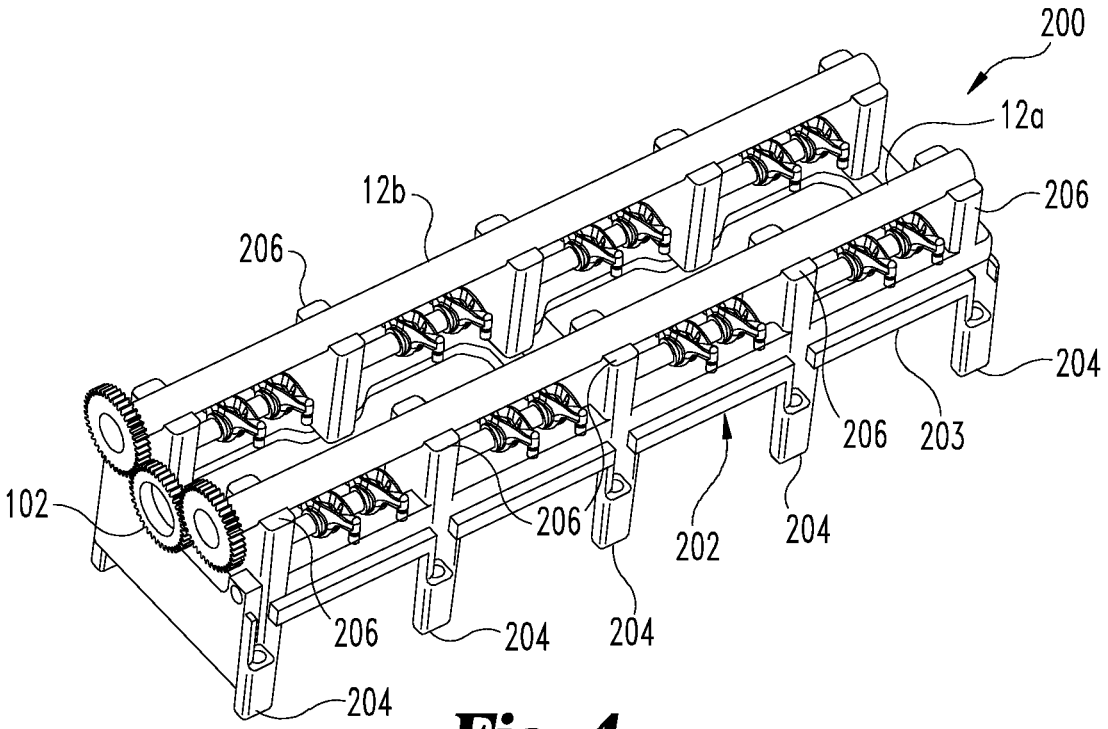
FIG. 4 is a perspective view of another embodiment dual overhead cam support system which would be mounted to the engine block.

FIG. 4 shows one bank of another embodiment overhead cam support system 200 for a V-8 configuration engine with double overhead valvetrain. Cam support system 200 incorporates a single piece cam carrier housing 202 with mounting legs 204 that extend downwardly from the center wall section 203 of housing 202 for engagement with the engine block 100. Each of the legs 204 includes a bore to receive an elongated bolt or other fastener for connection of carrier housing 202 to the engine block. The central drive gear 102 is mounted to the carrier housing 202 to allow the assembly to be removed in one piece and with the timing locked in place. Carrier housing 202 also includes cam support arms 206 that extend upwardly from center wall section 203 and inwardly toward one another to support camshafts 12*a*, 12*b* relative to the cylinder heads.

Figure 5:
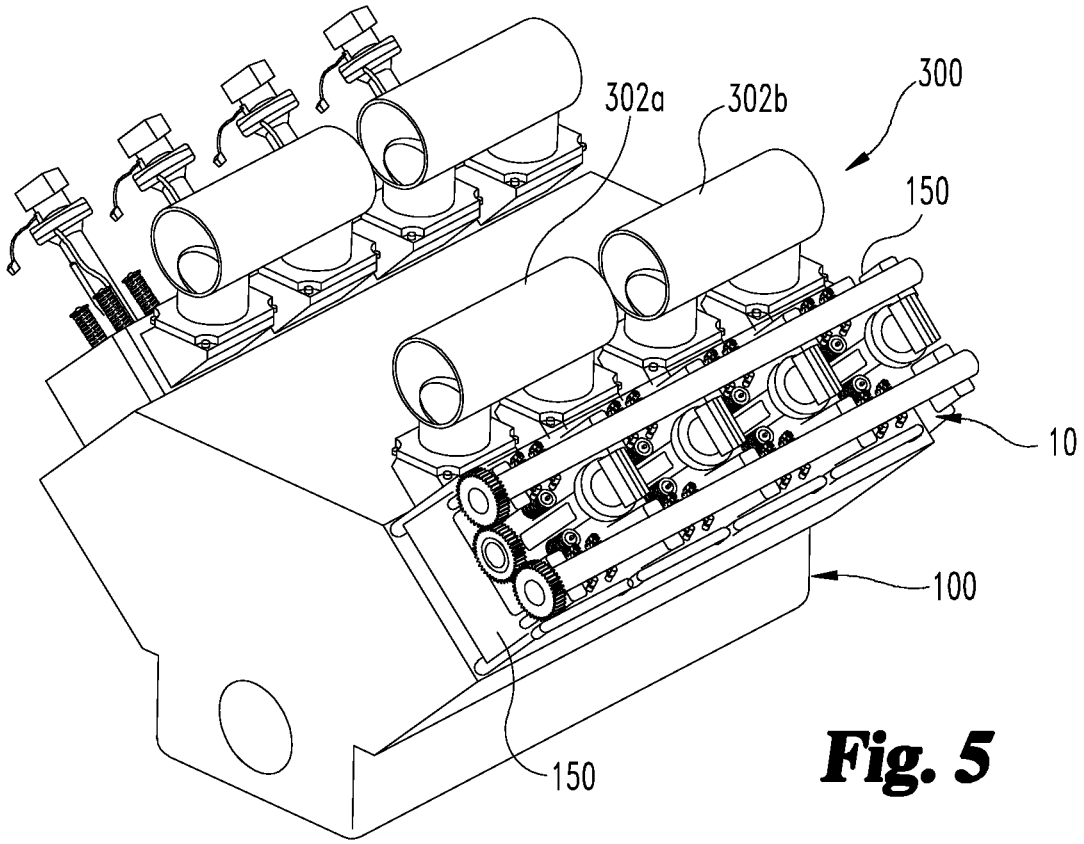
FIG. 5 is a perspective view of an engine block with an inboard exhaust system and a dual overhead cam support system mounted to the engine block.

FIG. 5 shows one embodiment of an inboard exhaust system 300 using multiple sections 302*a*, 302*b* that could be joined together with a flexible connection, such as a bellows or sliding piston type joint. Each section 302*a*, 302*b* sits on a common mounting face of a respective cylinder head 150 to help to reduce assembly variation and tolerance stack up. The exhaust system 300 arranged in this example can use a log manifold, and the extra material in the cylinder head 150 for supporting the respective exhaust manifold section can also include internally a pulse converter to reduce the effect of cylinder back filling, thus improving engine scavaging capability and reducing in-cylinder residuals.

Figure 6:
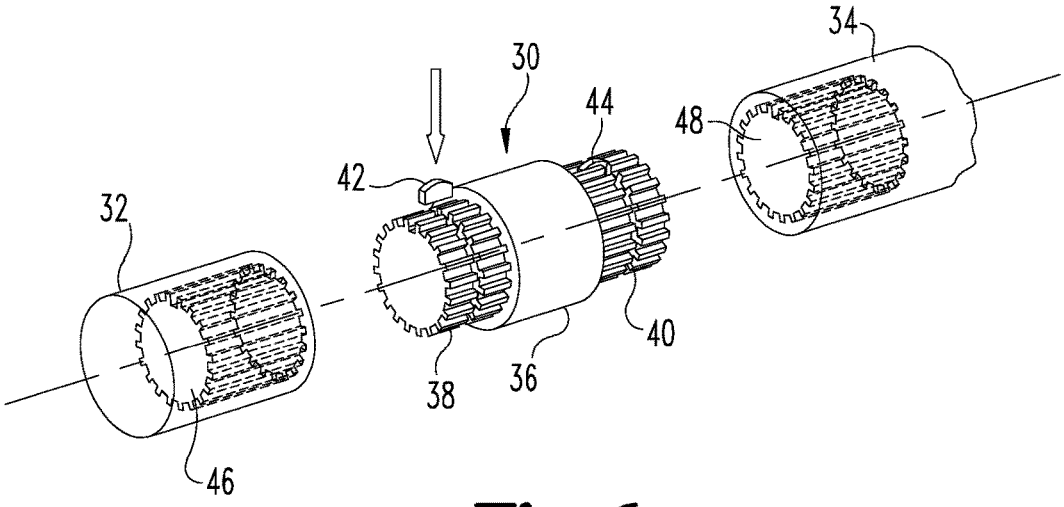
FIG. 6 is an exploded perspective view of one embodiment of a coupling arrangement between camshaft sections.

FIG. 6 shows one embodiment of a camshaft coupling 30. The camshaft coupling 30 can connect two camshaft sections 32, 34 to one another in end-to-end fashion. In one embodiment, coupling 30 includes a center hub 36 with splined sections 38, 40 extending axially in opposite directions from center hub 36. In addition, each splined section includes a key 42, 44 projecting radially outwardly therefrom. Camshaft sections 32, 34 each include a longitudinal bore 46, 48 with a corresponding keyway that receives respective ones of the splined sections 38, 40 and its associated key 42, 44 in the keyway. In certain embodiments, splined sections 38, 40 include other configurations, such as a D-shaped or other shape that is received in a correspondingly complementary non-circular shaped longitudinal bore 46, 48. The camshaft coupling 30 can be used to connect camshaft sections in engines that, for example, have more than 8 cylinders.

Figure 7:
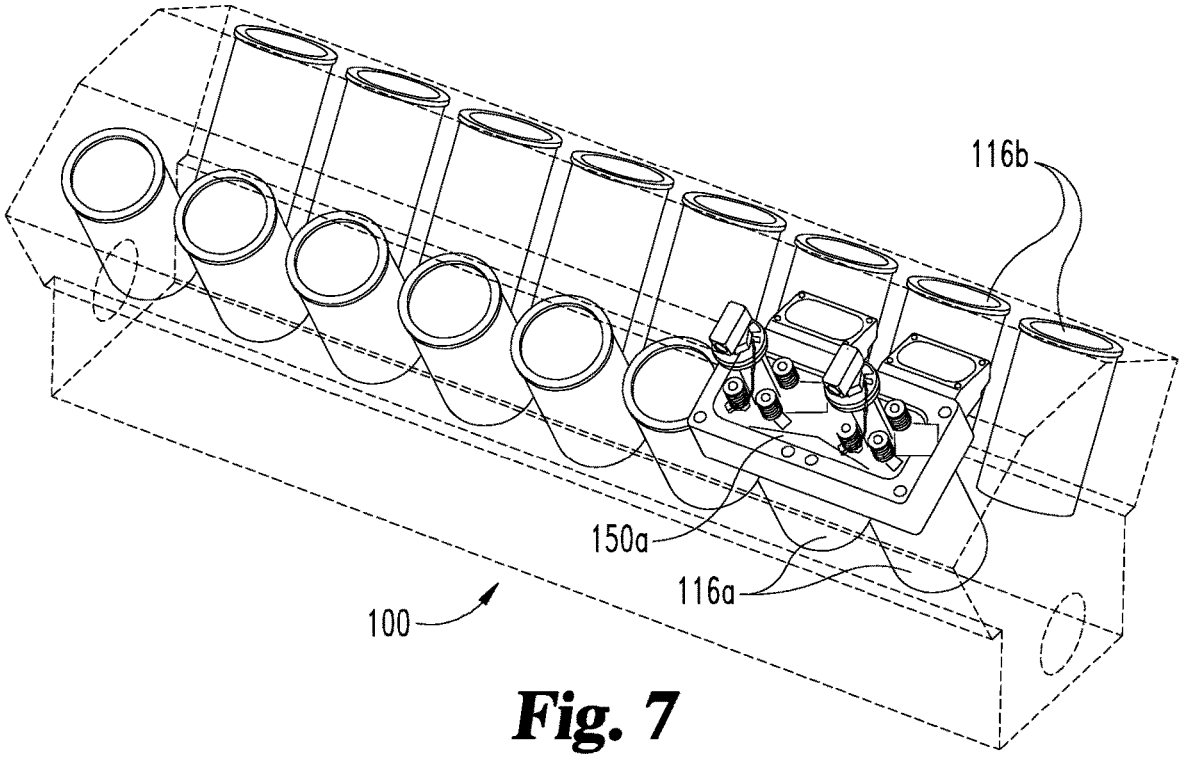
FIG. 7 is a perspective view of a single two cylinder head of a V-16 engine embodiment.
Figure 8:
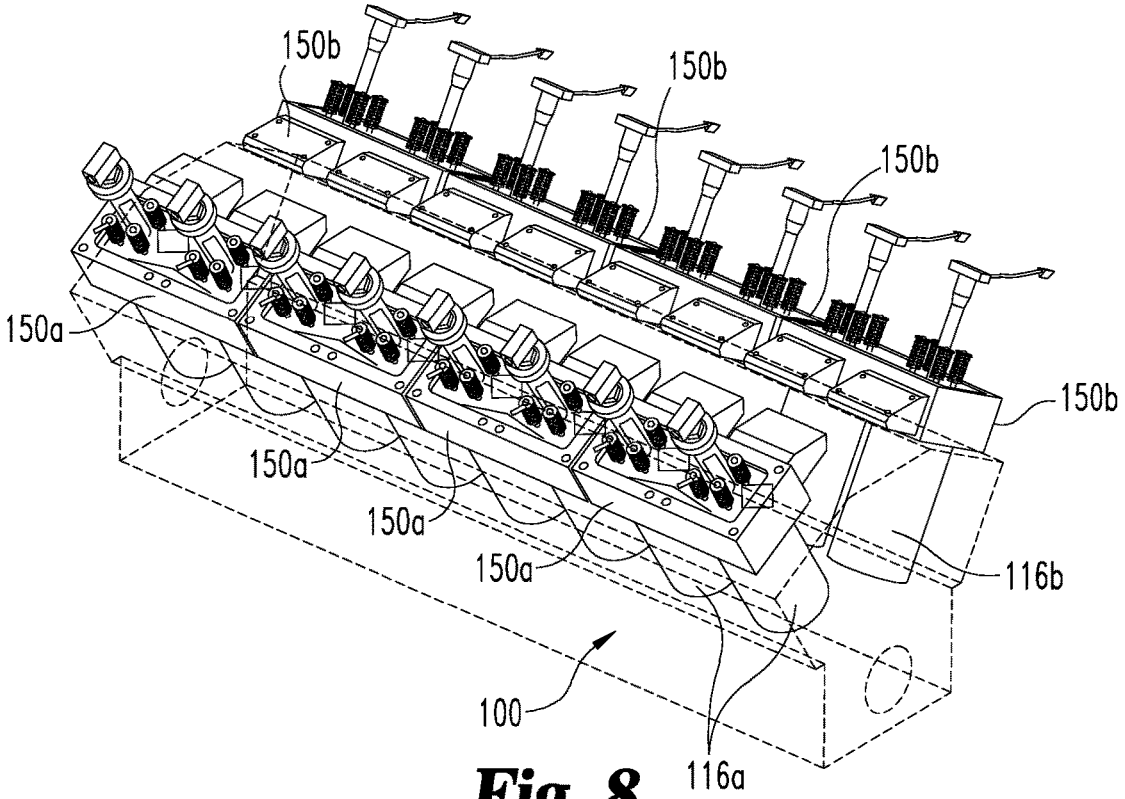
FIG. 8 is the engine of FIG. 7 with multiple two cylinder heads arranged on the cylinders of the engine block.

FIGS. 7-11 show another embodiment overhead cam support system 400 in which the carrier housing is comprised of multiple sections. In FIG. 7 an engine block 100 is shown with sixteen cylinders 116 and one pair of the cylinders 116*a* of a first cylinder bank is covered by a first cylinder head 150. FIG. 8 shows the same block 100 with cylinders 116*a* in the first cylinder bank and cylinders 116*b* in a second cylinder bank, and with eight cylinder heads 150*a*, 150*b* over respective pairs of the cylinders 116*a*, 116*b*.

Figure 9:
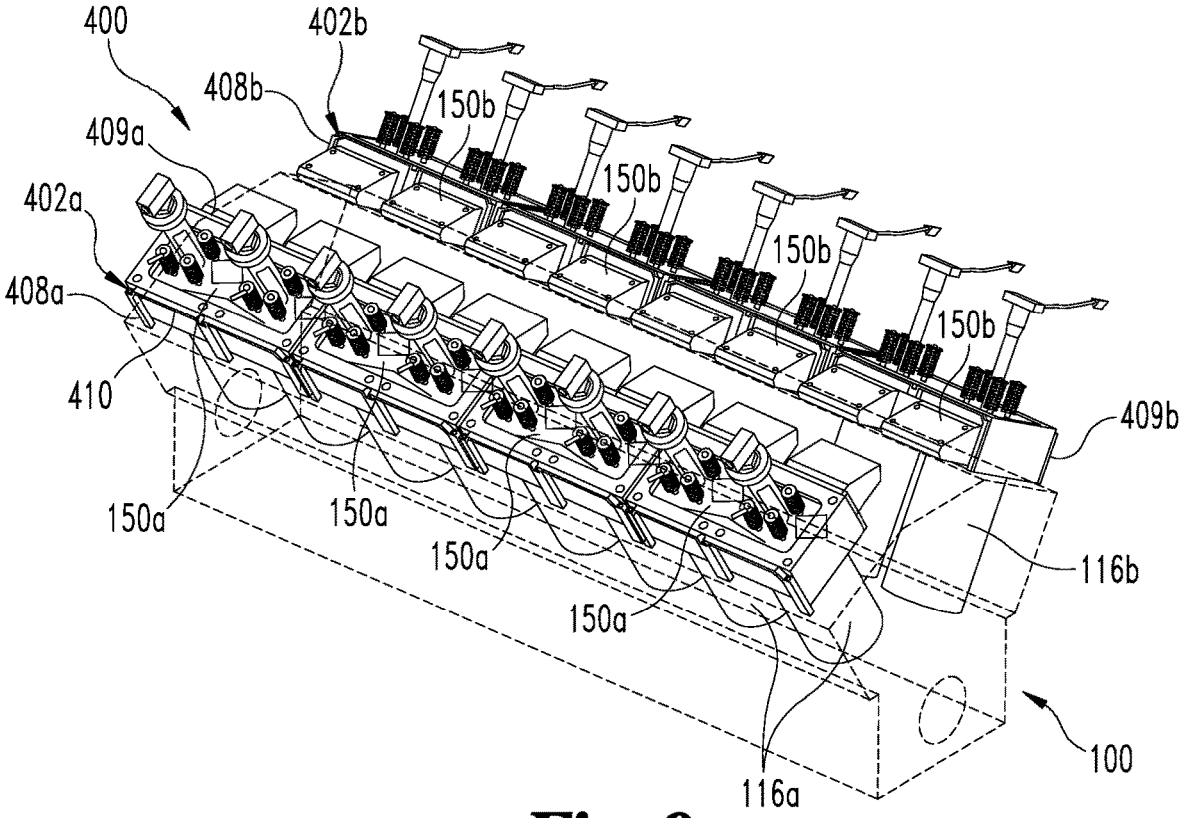
FIG. 9 is the engine of FIG. 7 with support legs of the dual overhead cam support system mounted to the engine block.

In FIG. 9 cam support system 400 includes a lower carrier housing section 402*a* with legs 408*a*, 409*a* (see also FIG. 11) along the opposite sides of cylinder heads 150*a* and the valve train of the first cylinder bank, and a second lower carrier housing section 402*b* with legs 408*b*, 409*b* along the opposite sides of cylinder heads 150*b* and the valve train of the second cylinder bank. Legs 408*a*, 409*a* and legs 408*b*, 409*b* are provided at each end of each cylinder head 150*a*, 150*b* and between adjacent ones of the cylinder heads 150*a*, 150*b*. The legs 408*a*, 409*a*, 408*b*, 409*b* on each side of the cylinder heads 150*a*, 150*b* are connected by a flange 410, and a plurality of bores are provided in legs 408*a*, 408*b*, 409*a*, 409*b* and flanges 410 to receive bolts to secure the lower section to block 100.

Figure 10:
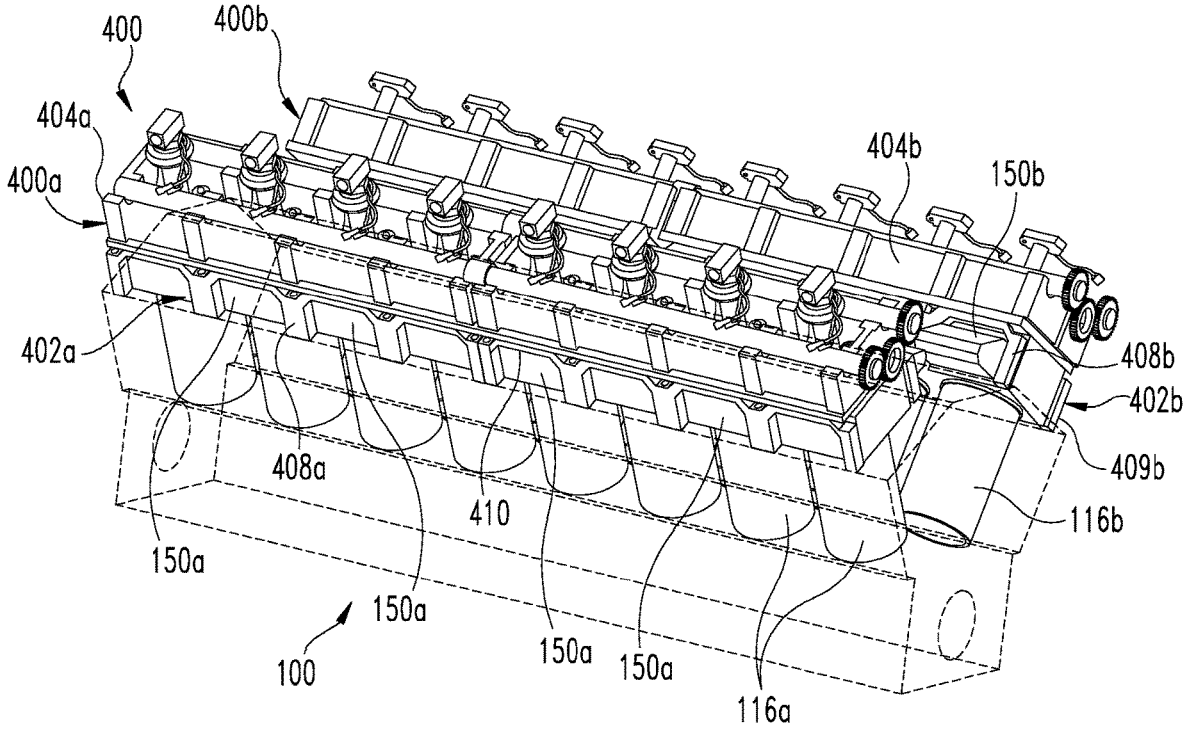
FIG. 10 is the engine of FIG. 9 with the cam carriers mounted to the support legs and drive couplings engaged to the cams.
Figure 11:
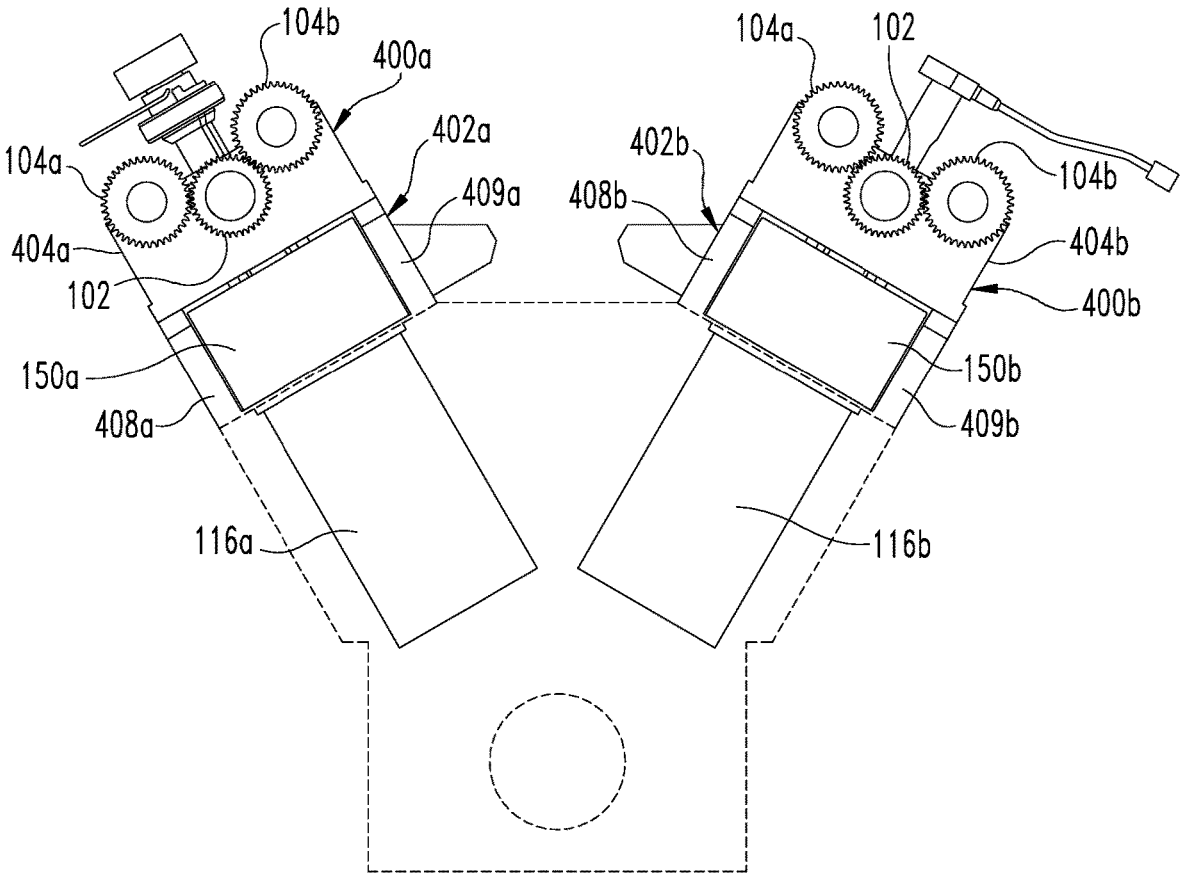
FIG. 11 is an end view of the engine and cam support system of FIG. 10.

FIGS. 10 and 11 show the overhead cam support system 400 with upper sections 404*a*, 404*b* mounted the respective lower sections 402*a*, 402*b*. In the illustrated embodiment, each upper section 404*a*, 404*b* includes two parts that each span two cylinder pairs 150*a*, 150*b*. The upper sections 404*a*, 404*b* each have a rectangular shape with opposite sidewalls and endwalls connecting the opposite sidewalls, and the idler gear 102 connected to one of the endwalls of each upper section 404*a*, 404*b*. This embodiment reduces machining complexity of the cam support system 400, and improves serviceability, especially in applications where the front or rear of the engine is constrained and access restricted.

Various aspects of the present disclosure are contemplated. According to one aspect, an overhead cam support system includes a carrier housing with a lower end positionable on an engine block independently of a cylinder head of the engine. The carrier housing rotatably supports at least one camshaft on the engine block for engagement with at least one valve of the cylinder head.

In one embodiment, the system includes a valve cover engaged to an upper end of the carrier housing that is opposite the lower end of the carrier housing. In one refinement of this embodiment, the carrier housing includes a flange extending over an upper surface of the cylinder head, and a seal is provided between the flange and an upper surface of the cylinder head. In another refinement, the carrier housing includes at least one cam support arm extending outwardly therefrom adjacent the upper end of the carrier housing, and the camshaft is supported on the at least one cam support arm. In a further refinement, the system includes a camshaft retaining cap engaged to the cam support arm and the camshaft retaining cap extends around the at least one camshaft.

In another embodiment, the at least one camshaft includes first and second camshafts including respective ones of first and second cam gears or phasers that are engaged to an idler gear mounted to the carrier housing. In yet another embodiment, the carrier housing includes first legs and second legs extending on opposite sides of the cylinder head and a first flange and a second flange extending along opposite sides of the cylinder head connecting the first legs and the second legs, respectively. In still another embodiment, the engine block includes at least eight cylinders and each cylinder head extends over two cylinders.

In another embodiment the at least one camshaft includes at least two camshaft sections connected to one another in an end-to-end manner. In a refinement of this embodiment, the system includes a camshaft coupling that includes a center hub with splined sections extending axially in opposite directions from the center hub, and each camshaft section includes a longitudinal bore configured to receive respective ones of the splined sections. In a further refinement, each splined section includes a key projecting radially outwardly therefrom that is received in a keyway along the longitudinal bore of the respective cam section. In another further refinement, each splined section includes a non-circular cross-section that is received in a complementary shaped one of the longitudinal bores.

In yet another refinement, a first camshaft section is sized to extend along three cylinder pairs and a second camshaft section is sized to extend along two cylinder pairs, and the first and second camshaft sections are connected in end-to-end relation. In still another refinement, a first camshaft section is sized to extend along two cylinder pairs and a second camshaft section is sized to extend along two cylinder pairs, and the first and second camshaft sections are connected in end-to-end relation. In another embodiment, a first camshaft section is sized to extend along two cylinder pairs and a second camshaft section is sized to extend along one cylinder pair, and the first and second camshaft sections are connected in end-to-end relation. In yet another embodiment, a first camshaft section is sized to extend along three cylinders and a second camshaft section is sized to extend along three cylinders, and the first and second camshaft sections are connected in end-to-end relation.

In another embodiment, the carrier housing includes a plurality of bores for receiving fasteners to secure the carrier housing to the engine block. In yet another embodiment, the engine block is configured for an in-line engine cylinder arrangement. In one refinement, the number of cylinders is at least six.

In another embodiment, the engine block is configured for a V-shaped engine cylinder arrangement. In yet another embodiment, the camshaft is a single piece, single overhead camshaft. In a further embodiment, the camshaft includes at least two camshafts positioned in a double overhead arrangement and each of the at least two camshafts is a single piece camshaft. In still another embodiment, the system is a cam-less valve train.

According to another aspect of the present disclosure, an overhead cam support system includes a carrier housing configured to extend around a cylinder head of an engine. The carrier housing includes a lower end supported on an engine block of the engine independently of the cylinder head. The carrier housing includes at least one cam support arm extending over the cylinder head that rotatably supports at least one camshaft on the engine block.

In one embodiment, the system includes a camshaft retaining cap engaged to the cam support arm and the camshaft retaining cap extends around the at least one camshaft. In another embodiment, the carrier housing includes a plurality of first legs and a plurality of second legs on opposite sides of the cylinder head. The plurality of first and second legs each define a bore for receiving a fastener to secure the carrier housing to the engine block. In yet another embodiment, the carrier housing includes a flange extending over an upper surface of the cylinder head, and a seal is provided between the flange and an upper surface of the cylinder head.

In another aspect of the present disclosure, an overhead cam support system includes a lower carrier housing section and an upper carrier housing section mounted on the lower carrier housing section. The lower carrier housing section includes a plurality of legs with lower ends supported on an engine block along opposite sides of a cylinder head of an engine independently of the cylinder head. The lower carrier housing further includes flanges extending between and connecting adjacent pairs of the plurality of legs. The upper carrier housing section includes opposite sidewalls and opposite endwalls connecting the opposite sidewalls. The opposite endwalls are configured to rotatably support at least one camshaft along the cylinder head.

In one embodiment, at least a portion of the plurality of legs include a bore for receiving a fastener to secure the lower carrier housing section to the engine block. In another embodiment, the upper carrier housing section includes at least one cam support arm extending from one of the opposite sidewalls over the cylinder head and the camshaft is supported on the at least one cam support arm.

While the invention has been illustrated and described in detail in the drawings and foregoing description, the same is to be considered as illustrative and not restrictive in character, it being understood that only certain exemplary embodiments have been shown and described and that all changes and modifications that come within the spirit of the inventions are desired to be protected. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An overhead cam support system, comprising:

a cylinder head including at least one valve;

a carrier housing rotatably supporting at least one camshaft on an engine block, the at least one camshaft configured to engage the at least one valve of the cylinder head, wherein the cylinder head and carrier housing are each directly connected to the engine block independently of each other.

2. The overhead cam support system of claim 1, further comprising a valve cover engaged to an upper end of the carrier housing that is opposite a lower end of the carrier housing that is directly connected to the engine block.

3. The overhead cam support system of claim 2, wherein the carrier housing further includes a flange extending over an upper surface of the cylinder head, and further comprising a seal between the flange and the upper surface of the cylinder head.

4. The overhead cam support system of claim 2, wherein the carrier housing further includes at least one cam support arm extending outwardly from the carrier housing adjacent the upper end of the carrier housing, and the at least one camshaft is supported on the at least one cam support arm.

5. The overhead cam support system of claim 4, further comprising a camshaft retaining cap engaged to the at least one cam support arm and the camshaft retaining cap extends around the at least one camshaft.

6. The overhead cam support system of claim 1, wherein the at least one camshaft includes first and second camshafts each including a cam gear or a phaser that is engaged to an idler gear mounted to the carrier housing.

7. The overhead cam support system of claim 1, wherein the carrier housing further includes first legs extending on one side of the cylinder head and second legs extending on an opposite side of the cylinder head, wherein each of the first legs and the second legs includes a bore configured to receive a bolt which engages the carrier housing to the cylinder block, and the carrier housing further includes a first flange extending between and connecting the first legs and a second flange extending between and connecting the second legs.

8. The overhead cam support system of claim 1, wherein the engine block includes at least eight cylinders and the carrier housing extends over only two cylinders of the at least eight cylinders.

9. The overhead cam support system of claim 1, wherein the at least one camshaft includes at least two camshaft sections connected to one another in an end-to-end manner.

10. The overhead cam support system of claim 9, further comprising a camshaft coupling that includes a center hub with splined sections extending axially in opposite directions from the center hub, and each camshaft section includes a longitudinal bore configured to receive a respective one of the splined sections.

11. The overhead cam support system of claim 10, wherein each splined section includes a radially outwardly projecting key that is received in a keyway along the longitudinal bore of a respective one of the at least two camshaft sections.

12. The overhead cam support system of claim 10, wherein each longitudinal bore includes a non-circular cross-section that is configured to complement a non-circular cross-section of the respective one of the splined sections.

13. The overhead cam support system of claim 9, wherein a first camshaft section of the at least two camshaft sections is sized to extend along three cylinder pairs of the at least eight cylinders and a second camshaft section of the at least two camshaft sections is sized to extend along two cylinder pairs of the at least eight cylinders.

14. The overhead cam support system of claim 9, wherein a first camshaft section of the at least two camshaft sections is sized to extend along two cylinder pairs of the at least eight cylinders and a second camshaft section of the at least two camshaft sections is sized to extend along two cylinder pairs of the at least eight cylinders.

15. The overhead cam support system of claim 9, wherein a first camshaft section of the at least two camshaft sections is sized to extend along two cylinder pairs of the at least eight cylinders and a second camshaft section of the at least two camshaft sections is sized to extend along one cylinder pair of the at least eight cylinders.

16. The overhead cam support system of claim 9, wherein a first camshaft section of the at least two camshaft sections is sized to extend along three cylinders of the at least eight cylinders and a second camshaft section of the at least two camshaft sections is sized to extend along three cylinders of the at least eight cylinders.

17. The overhead cam support system of claim 1, wherein the carrier housing further includes a plurality of bores configured to receive fasteners which secure the carrier housing to the engine block independently of the cylinder head such that flexing of the cylinder head does not transfer load to the at least one camshaft.

18. The overhead cam support system of claim 1, wherein the engine block is configured for an in-line engine cylinder arrangement.

19. The overhead cam support system of claim 18, wherein the engine block includes at least six cylinders.

20. The overhead cam support system of claim 1, wherein the engine block is configured for a V-shaped engine cylinder arrangement.

21. The overhead cam support system of claim 1, wherein the at least one camshaft is a single piece, single overhead camshaft.

22. The overhead cam support system of claim 1, wherein the at least one camshaft includes at least two camshafts positioned in a double overhead arrangement and each of the at least two camshafts is a single piece camshaft.

23. The overhead cam support system of claim 1, wherein the carrier housing is a rectangular shaped housing further comprising:

first and second wall portions extending along opposite sides of at least two cylinders of the cylinder head; and end wall portions at opposite ends of the at least two cylinders that extend between the first and second wall portions, wherein each of the first and second wall portions and the end wall portions includes a lower end sitting on the engine block and an opposite upper end engaged to a valve cover.

24. An overhead cam support system, comprising:

a carrier housing configured to extend around a cylinder head of an engine, the carrier housing including opposite side wall portions extending along the cylinder head and opposite end wall portions between the opposite side wall portions that each include a lower end directly connected to an engine block of the engine independently of the cylinder head, the carrier housing including at least one cam support arm extending over the cylinder head that rotatably supports at least one camshaft on the engine block.

25. The overhead cam support system of claim 24, further comprising a camshaft retaining cap engaged to the at least one cam support arm and the camshaft retaining cap extends around the at least one camshaft.

26. The overhead cam support system of claim 24, wherein the carrier housing further includes a plurality of first legs and a plurality of second legs on opposite sides of the cylinder head, wherein the plurality of first and second legs each define a bore configured to receive a fastener which secures the carrier housing to the engine block independently of the cylinder head such that flexing of the cylinder head does not transfer load to the at least one camshaft.

27. The overhead cam support system of claim 24, wherein each of the side wall portions and the end wall portions of the carrier housing includes a flange extending over an upper surface of the cylinder head, and further comprising a seal between the flange and the upper surface of the cylinder head.

28. An overhead cam support system, comprising:

a lower carrier housing section that includes a plurality of legs with lower ends directly connected to an engine block along opposite sides of a cylinder head of an engine independently of the cylinder head, the lower carrier housing section further comprising flanges extending between and connecting adjacent legs; and an upper carrier housing section mounted on the lower carrier housing section, the upper carrier housing section including opposite sidewalls and opposite end walls connecting the opposite sidewalls, wherein the opposite end walls are configured to rotatably support at least one camshaft along the cylinder head.

29. The overhead cam support system of claim 28, wherein at least a portion of the plurality of legs include a bore configured to receive a fastener which secures the lower carrier housing section to the engine block independently of the cylinder head such that flexing of the cylinder head does not transfer load to the at least one camshaft.

30. The overhead cam support system of claim 28, wherein the upper carrier housing section includes at least one cam support arm extending from one of the opposite sidewalls over the cylinder head and the at least one camshaft is supported on the at least one cam support arm.

* * * * *